US011401069B1

(12) United States Patent
Xu et al.

(10) Patent No.: US 11,401,069 B1
(45) Date of Patent: Aug. 2, 2022

(54) GAS INJECTED AUTO-DUNNAGE FORMATION WITHIN A FILLED AND SEALED CONTAINER

(71) Applicant: Amazon Technologies, Inc., Seattle, WA (US)

(72) Inventors: Toby Ge Xu, Seattle, WA (US); Jon Stuart Battles, North Bend, WA (US); Martin Peter Aalund, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 187 days.

(21) Appl. No.: 16/942,598

(22) Filed: Jul. 29, 2020

Related U.S. Application Data

(62) Division of application No. 15/195,393, filed on Jun. 28, 2016, now Pat. No. 10,737,819.

(51) Int. Cl.
*B65B 61/22* (2006.01)
*B65B 7/16* (2006.01)
*B65B 5/04* (2006.01)

(52) U.S. Cl.
CPC ..... *B65B 61/22* (2013.01); *B65B 5/04* (2013.01); *B65B 7/16* (2013.01)

(58) Field of Classification Search
CPC ..... B65D 81/051; B65D 81/052; B65B 9/12; B65B 9/13; B65B 9/15; B65B 55/20; B65B 61/22; B65B 5/04; B65B 61/20; B65B 81/09; B31F 5/0039; B31F 5/0073; B31D 2205/007
USPC ..... 53/403, 79, 459, 469, 567, 576, 472, 53/139.5, 396, 467, 474, 235; 493/967
See application file for complete search history.

(56) References Cited

U.S. PATENT DOCUMENTS 3,254,828 A * 6/1966 Lerner ..... B65B 43/267 206/820
3,412,521 A * 11/1968 Bauman ..... B65B 55/20 53/472
3,509,797 A * 5/1970 Johnson ..... B31D 5/0047 53/502
3,514,157 A * 5/1970 Geiser ..... B65D 81/052 206/522
3,868,026 A * 2/1975 Baxter ..... B65D 81/052 206/522
3,889,743 A * 6/1975 Presnick ..... B65D 81/3858 62/529
3,945,171 A * 3/1976 Marietta, Jr. ..... B65B 31/06 53/512
4,346,546 A * 8/1982 Tasker ..... B65B 9/13 53/385.1
4,384,442 A * 5/1983 Pendleton ..... B29C 49/0047 53/554

(Continued)

*Primary Examiner* — Thomas M Wittenschlaeger
*Assistant Examiner* — Katie L Gerth
(74) *Attorney, Agent, or Firm* — Athorus, PLLC

(57) ABSTRACT

Described are systems, methods, and apparatus for injecting dunnage into a container after an item has been placed in the container and the container has been sealed or otherwise closed. A dunnage injection apparatus is configured to penetrate a surface of the sealed container and expel gas and dunnage into an interior space of the container. The gas fills the expelled dunnage forming gas-filled pouches of dunnage that fill voids within the interior space of the container and secure and protect the item within the container.

20 Claims, 8 Drawing Sheets

(56) References Cited

U.S. PATENT DOCUMENTS 4,564,407 A * 1/1986 Tsuruta ..... B29C 49/0047 156/203
4,640,080 A * 2/1987 Wright ..... B65D 81/09 53/472
4,644,733 A * 2/1987 Dolinar ..... B65D 81/09 53/472
4,674,268 A * 6/1987 Gavronsky ..... B31D 5/0078 141/10
4,713,927 A * 12/1987 Rubens ..... B65B 55/20 53/472
4,717,025 A * 1/1988 Maurer ..... B65D 19/20 108/55.3
4,821,485 A * 4/1989 Evans ..... B65B 51/04 29/243.57
5,042,663 A * 8/1991 Heinrich ..... B65D 81/052 206/820
5,079,901 A * 1/1992 Kotsiopoulos ..... B65B 57/06 53/238
5,257,492 A * 11/1993 Watts ..... B31F 1/0077 53/118
5,339,602 A * 8/1994 Landers ..... B29C 66/432 53/445
5,397,000 A * 3/1995 Holte ..... B65D 81/052 206/545
5,454,407 A * 10/1995 Huza ..... B60P 7/065 141/10
5,463,851 A * 11/1995 Nagai ..... B29C 66/83221 53/374.8
5,643,167 A * 7/1997 Simmons ..... B65D 81/02 493/464
5,693,163 A * 12/1997 Hoover ..... B31D 5/0078 53/472
5,806,572 A * 9/1998 Voller ..... B65D 81/052 141/10
5,901,850 A * 5/1999 Jones ..... B65D 81/052 383/3
5,910,089 A * 6/1999 Weder ..... B65D 81/09 53/472
6,076,677 A * 6/2000 Pozzo ..... B65D 81/052 383/3
RE36,759 E * 7/2000 Hoover ..... B65B 43/123 53/472
6,094,895 A * 8/2000 Ravizza ..... B65B 51/26 53/567
6,128,889 A * 10/2000 Fuss ..... B65B 67/06 53/472
6,135,869 A * 10/2000 Schutz ..... B65B 9/12 53/433
6,138,441 A * 10/2000 Kik ..... B65B 9/20 53/551
6,199,349 B1 * 3/2001 Lerner ..... B31D 5/0073 53/472
6,244,164 B1 * 6/2001 Perez Gonzalvo ... A47J 37/044 99/335
6,398,029 B1 * 6/2002 Farison ..... B65D 81/052 206/592
6,560,948 B1 * 5/2003 Fuss ..... B65D 81/051 53/472
6,561,236 B1 * 5/2003 Sperry ..... B60P 7/065 141/114
6,626,812 B1 * 9/2003 Harding ..... B31D 5/0047 493/464
6,854,246 B2 * 2/2005 Savage ..... B65D 77/06 53/472
7,455,086 B1 * 11/2008 Elze ..... B65B 39/02 141/37
7,490,449 B1 * 2/2009 Eibert ..... B29C 65/1467 53/553
8,319,630 B1 * 11/2012 Salwan ..... A45C 15/06 383/61.3
8,601,775 B1 * 12/2013 Rowley ..... B65D 5/5028 53/472
8,668,418 B2 3/2014 Root
8,960,436 B1 * 2/2015 Smith ..... B65D 81/027 53/472
2001/0001921 A1 * 5/2001 Sperry ..... B60P 7/065 53/88
2001/0013215 A1 * 8/2001 Fuss ..... B29C 65/743 53/553
2007/0172326 A1 * 7/2007 Sperry ..... B65B 55/20 410/125
2008/0041023 A1 * 2/2008 Tsuruta ..... B29C 66/8181 53/548
2008/0203090 A1 * 8/2008 Dickinson ..... B65D 81/051 220/1.5
2009/0293427 A1 * 12/2009 Lerner ..... B31D 5/0073 53/477
2010/0275557 A1 * 11/2010 Buta ..... B65G 57/005 53/139.5
2011/0172072 A1 * 7/2011 Wetsch ..... B31D 5/0073 493/227
2012/0114505 A1 * 5/2012 Pansegrouw ..... B60P 7/065 417/189
2013/0139601 A1 * 6/2013 Tschantz ..... B05B 1/005 73/700
2013/0205724 A1 * 8/2013 Straver ..... B65B 67/02 53/238
2014/0121089 A1 * 5/2014 Brooks ..... B65D 77/065 493/133
2015/0210417 A1 * 7/2015 Donati ..... B65B 51/20 251/315.1
2015/0283781 A1 * 10/2015 Wetsch ..... B31D 5/0073 53/79
2016/0021911 A1 * 1/2016 Beuchert ..... B65B 25/005 141/105
2017/0129630 A1 * 5/2017 Weibel ..... B65B 31/00

* cited by examiner

GAS INJECTED AUTO-DUNNAGE FORMATION WITHIN A FILLED AND SEALED CONTAINER

PRIORITY CLAIM

This application is a divisional of U.S. patent application Ser. No. 15/195,393, filed Jun. 28, 2016, and titled "Injecting Dunnage Into A Closed Item Shipping Container," the contents of which are herein incorporated by reference in their entirety.

BACKGROUND

Many companies package items and/or groups of items together for a variety of purposes, such as e-commerce and mail-order companies that package items (e.g., books, CDs, apparel, food, etc.) to be shipped to fulfill orders from customers. Retailers, wholesalers, and other product distributors (which may collectively be referred to as distributors) typically maintain an inventory of various items that may be ordered by clients or customers. This inventory may be maintained and processed at a materials handling facility which may include, but is not limited to, one or more of: warehouses, distribution centers, cross-docking facilities, order fulfillment facilities, packaging facilities, shipping facilities, or other facilities or combinations of facilities for performing one or more functions of material (inventory) handling.

When one or more items are ordered for delivery to a destination, the item(s) is picked from inventory, a corrugated container that is of a size sufficient to contain the item(s) is selected, the item(s) is packed into the container, dunnage, such as paper, air filled bags, etc. is added to protect the item(s) during shipment, the container is closed and sealed, and the item is shipped to a destination in the container.

BRIEF DESCRIPTION OF THE DRAWINGS

The detailed description is set forth with reference to the accompanying figures. In the figures, the left-most digit(s) of a reference number identifies the figure in which the reference number appears.

Figure 1:
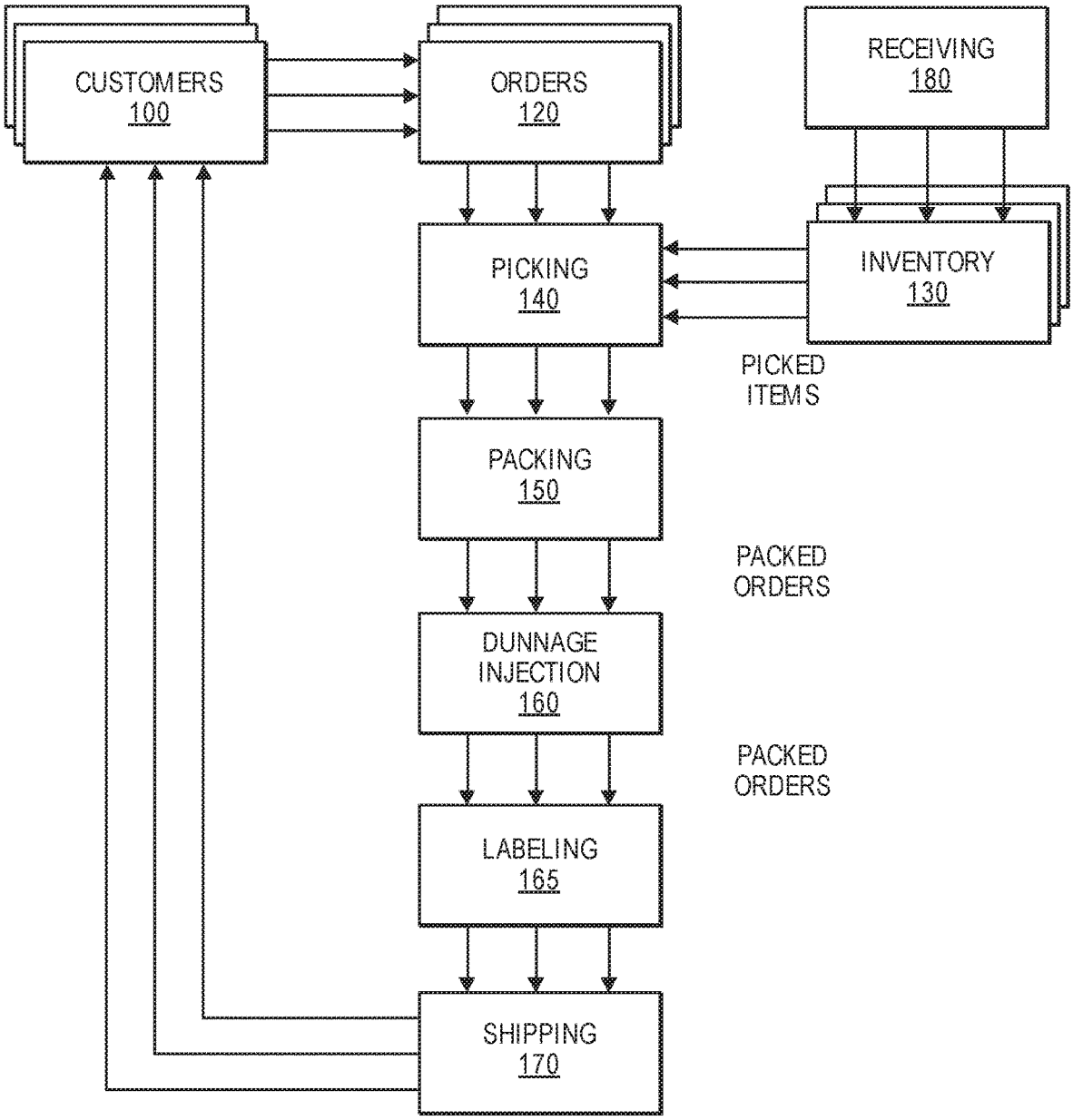
FIG. 1 illustrates a broad view of the operations of a materials handling facility, according to an implementation.

While implementations are described herein by way of example, those skilled in the art will recognize that the implementations are not limited to the examples or drawings described. It should be understood that the drawings and detailed description thereto are not intended to limit implementations to the particular form disclosed, but on the contrary, the intention is to cover all modifications, equivalents and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

Described are systems, methods, and apparatus for injecting dunnage, in the form of gas-filled polymer pouches, into a container after an item has been placed in the container and the container has been sealed or otherwise closed. When one or more items are to be shipped or transported from a source location (e.g., a materials handling facility) to a destination (e.g., a user specified delivery address), the item(s) is picked from inventory, placed or packed into a container, and the container is sealed or otherwise closed so that the item can be transported in the container. For example, an agent may seal a container by closing the top flaps of the container and applying tape over one or more seams of the closed flaps and/or gluing the flaps closed, thereby closing and sealing the container so that the item will remain in the container during transport. A dunnage injection apparatus, as described herein, is then used to inject dunnage, in the form of gas-filled polymer pouches into the interior of the container so that the item is secured within the container.

Dunnage is frequently used to stabilize, secure, and protect items within a container, such as a cardboard shipping box, during transport. Typically, as an item is packed into the container, and before the container is closed and sealed, dunnage is placed in voids between the items and the interior surfaces of the container. However, because traditional techniques require that the dunnage be added to the interior of the container prior to the container being closed and sealed, it is difficult to properly position dunnage so that it will remain between the item and the interior of the top flaps of the container when the container is closed. Either too much dunnage is added or not enough dunnage is added. In instances when too much dunnage is added and the container is closed, the excessive dunnage will cause a bowing of the container, which makes shipping and transport more difficult because container stacking is compromised. When not enough dunnage is included and the container is closed, the item is not properly secured inside the container and may shift or move within the container during transport. Shifting of items within a container during transport is one of the leading causes of item damage during transport.

The described implementations reduce or resolve the above mentioned problems by injecting the dunnage into the interior of the container after the container is closed and sealed so that the dunnage can expand and adequately fill the void between the item and the interior of the flaps of the container. For example, the injected dunnage may expand as gas is injected into the dunnage and fills the void between the item and the interior surface of the container, thereby inhibiting movement of the item within the container. Likewise, dunnage may be injected into other voids within the container after the container is sealed, further securing the item within the container and protecting the item during transport.

A packaging information system configured to facilitate picking, packing and/or shipping operations may include various components used to facilitate efficient and/or cost-effective operations in a materials handling facility. For example, in various implementations, a packaging information system may include a planning service, a product dimension estimator, and one or more dunnage injection stations that include one or more dunnage injection apparatus. For example, the planning service may provide information as to the size and/or shape of the items to be packed so that a container of sufficient size may be selected or formed for packing the item. Likewise, the dimensions of the item(s) and the container may be used to determine an approximate pressure that is to be achieved when injecting gas into the polymer dunnage that is used to fill voids within the container after the item is packed and the container is closed and sealed for shipping. The pressure may depend on, for example, the approximate size of the void anticipated to be filled, the strength or rigidity of the container, the fragility of the item, etc.

In some implementations, one or more properties of the dunnage that is formed within the sealed container may also be dependent on the customer to whom the item is to be shipped, an applicable service level agreement, the destination of the item, the carrier selected for transporting the item, a fragility of the item, a weight of the item, and/or an environmental constraint associated with the item and/or the transport of the item (e.g., a restriction on the temperature and/or humidity at which the item should be held during transport). Example properties of the dunnage include but are not limited to, the size, shape, color, polymer material used to form the gas-filled pouch of dunnage, and/or the gas, or other substance, used to fill and expand the pouch that forms the dunnage.

As used herein, the term "item package" may refer to a single item to be stored, shipped, or otherwise enclosed within a container. A container includes any type of object that can be used to hold or transport one or more items and that may be closed or otherwise sealed such that the item is retained within the container until the container is opened. For example, a container may be a corrugated box having defined dimensions, a base, four sides, and a top that includes major and minor flaps that may be placed in a first position (opened) to enable access to an interior space of the container or placed in a second position (closed) to close the interior space of the container and inhibit access to the interior space of the container.

The dunnage may be formed of any type of polymer or other type of flexible material. For example, the dunnage may be polyethylene, low-density polyethylene (LDPE), linear low-density polyethylene (LLDPE), bioplastic, degradable polyethylene film, etc. In some implementations, the dunnage may be elastic such that it will stretch and expand as gas is injected into the dunnage. Likewise, the dunnage may be biodegradable such that the dunnage degrades through natural processes, such as hydrolysis, in the presence of moisture and/or heat. The dunnage may also be entirely composed of, utilize or include natural molecules, such as polysaccharides found in starch and cellulose, polyamides found in proteins, combinations of natural materials such as starch, cellulose fiber, and calcium carbonate, etc. Use of such natural materials promotes decomposition of the dunnage, thereby making the dunnage recyclable and/or compostable.

The gas used to fill and expand the injected dunnage may be any form of gas. For example, the gas may be air, oxygen, hydrogen, helium, nitrogen, carbon dioxide, etc., or any combination thereof. In some implementations, other substances may be used to fill and expand the injected dunnage. For example, a substance that is in liquid form when heated but substantially solid at room temperature may be injected into the dunnage to expand and fill the dunnage.

A block diagram of a materials handling facility which, in one implementation, may be an order fulfillment facility configured to utilize various systems and methods described herein, is illustrated in FIG. 1. In this example, multiple customers 100 may submit orders 120 to a distributor, where each order 120 specifies one or more items from inventory 130 to be shipped to the customer or to another entity specified in the order. An order fulfillment facility typically includes receiving operations 180 for receiving shipments of stock from various vendors and storing the received stock in inventory 130. To fulfill the orders 120, the one or more items specified in each order may be retrieved or "picked" from inventory 130 (which may also be referred to as stock storage) in the order fulfillment facility, as indicated by picking operations 140. In some implementations, the items in an order may be divided into multiple item packages for fulfillment by a planning service before item package fulfillment instructions are generated.

In some implementations, the picking operations 140 may communicate with a central control system, and receive a sequence for which items of an item package should be picked and delivered to a packing operation 150. The central control system, in some instances, may communicate with shipping operations 170 to determine a sequence in which ordered items should be picked so that they will progress through picking operations 140, packing operations 150, dunnage injection operations 160, and labeling operations 165 so that the packed items arrive at the shipping operations 170 in a manner that will facilitate stacking of containers that contain the items into transportation units.

In this example, picked items may be delivered to one or more stations in the order fulfillment facility for sorting operations into their respective orders or item packages, and then transferred to one or packing stations 150 where the items of an item package are placed into a container and the container is closed and sealed. Containers may be sealed using tape, glue or other form of adhesive. Once the container is sealed, access to the interior space that contains the items of the item package is restricted.

After the item has been packed into the container and the container sealed, the packed container is routed to a dunnage injection operation 160. As discussed further below, a dunnage injector penetrates a perimeter of the packed and sealed container and into the interior space of the container so that gas and dunnage may be expelled from the injector such that gas-filled pouches of dunnage are formed that at least partially fill a void within the interior space of the container. As the dunnage is filled with the gas, the dunnage may expand into the interior space and come into contact with one or more of the side, top or bottom surfaces of the container and/or the item packed in the interior space of the container. As the dunnage continues to be expelled and expand into the interior space, a volume or pressure of the expelled gas is monitored. When a defined volume of dunnage has been expelled, a defined volume of gas has been expelled, and/or when a defined pressure has been achieved, an end of the dunnage expelled from the injector may be sealed, thereby entraining the gas within the dunnage and the filled dunnage separated from the injector.

The sealed and dunnage injected container is then routed to a labeling station 165 where shipping information, such as a destination address is applied to the container. In some implementations, when a hole is left in the container as a result of the injector penetrating into the container, the label may be applied over the hole.

Finally, the sealed, dunnage injected, and labeled container may be routed to shipping operations 170. At the shipping operations 170, the container may be stacked onto or into a transportation unit and shipped to the customers 100.

Note that not every fulfillment facility may include both sorting and packing stations. In certain implementations, picked items may be transferred directly to a packing station, while in other implementations picked items may be transported to a combination sort, pack and dunnage injection station. This may result in a stream and/or batches of picked items for multiple incomplete or complete orders being delivered to a sort and pack station for packing operations 150 into their respective containers, according to some implementations.

Still further, in some implementations, items may be packed into containers and the containers sealed and then injected with dunnage as part of the receiving operations 180 such that the items are stored in inventory 130 after the items have been packed in containers, the containers sealed, and the containers injected with dunnage. In such an implementation, when an item is ordered, it may be picked from inventory and routed directly to shipping operations 170 for shipment.

While the above example is described with respect to packing the item into a container and subsequent dunnage injection, in some implementations, dunnage injection operations may be used in conjunction with traditional packaging of items in containers in which an initial amount of dunnage is added before the container is closed and sealed. For example, an item may be placed into a container and an initial amount of dunnage added to the container to partially fill the voids within the interior space of the container. The container may then be sealed and routed to dunnage injection station 160. Dunnage may then be injected into the interior space and filled with gas to consume empty space that remains in the container after the container has been sealed.

Note that a picked, packed, dunnage injected, and shipped item package does not necessarily include all of the items ordered by the customer. An item package may include only a subset of the ordered items available to ship at one time from one fulfillment facility. Also note that the various operations of an order fulfillment facility may be located in one building or facility, or alternatively may be spread or subdivided across two or more buildings or facilities.

The arrangement and order of operations illustrated by FIG. 1 is merely one example of many possible implementations of the operations of an order fulfillment facility. Other types of materials handling, manufacturing, or order fulfillment facilities may include different, fewer, or additional operations and resources, according to different implementations. For example, in some implementations, one or more dunnage injector stations may be utilized at receiving operations 180 such that received stock is packed in containers, sealed, dunnage injected and then stored in inventory.

Likewise, the operations of the order fulfillment facility may be manually performed or automated. For example, picking of items may be performed by one or more human agents that pick ordered items from inventory. Alternatively, picking operations may be performed by one or more robotic units that operate autonomously to pick and deliver items to packing and/or work in conjunction with human agents, picking and delivering items to the human agents for further processing.

Likewise, packing operations may be manual or automated. For example, a human agent may receive picked items and manually pack those items into a container, close and seal the container. Alternatively, packing operations may be partially or completely automated. For example, a container erection device, as is known in the art, may receive instructions indicating a size, shape or dimension of a container and form the container into which the item is to be placed. One or more robotic arms or other mechanisms may likewise be configured to receive the picked item, place the item into the container, close and seal the container.

As discussed in further detail below, the dunnage injection operations 160 may be partially or completely automated. Labeling and/or shipping operations may likewise be manual and/or automated.

Figure 2:
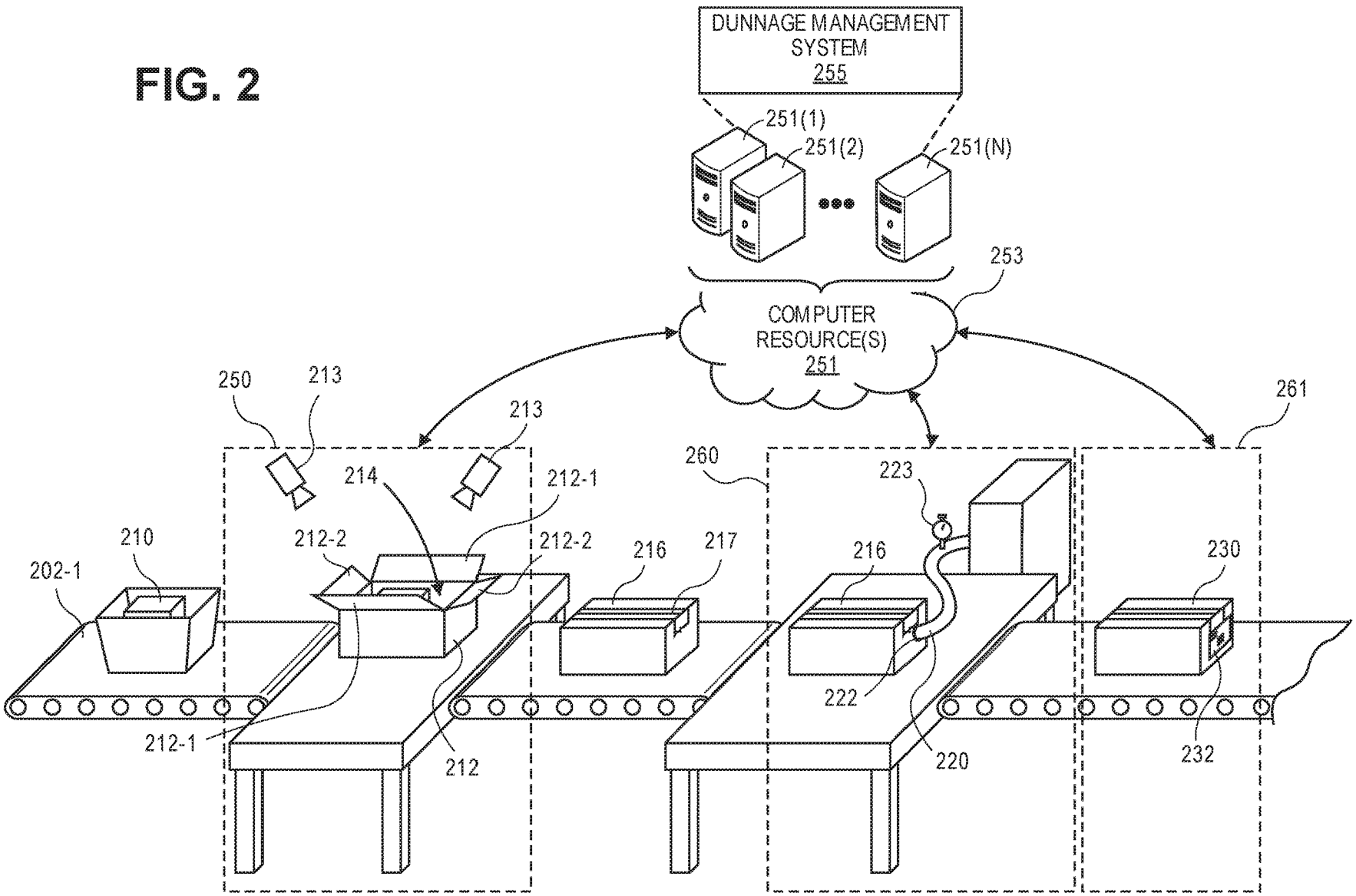
FIG. 2 illustrates an example view of a packing and dunnage injection station, according to an implementation.

FIG. 2 illustrates an example view of a packing station 250 and a dunnage injection station 260, and a labeling station 261, according to an implementation. As discussed above, the packing station 250 may also include sorting operations. For explanation purposes, the example will utilize a single item 210.

When an item is ordered, the item 210 is picked from inventory and, in this example, arrives at the packing station 250. The item progresses to the packing station via a first conveyor 202(1). When the item 210 arrives at the packing station, it is placed into the interior space 214 of a container 212. The container may be of any size and shape sufficient to contain the item 210. In the illustrated example, the container 212 includes a base surface, four sides, and a top formed of two major flaps 212-1 and two minor flaps 212-2. When the flaps 212-1, 212-2 are in an open position, as illustrated at the packing station, the interior space 214 of the container is accessible so that an agent or robotic unit can place the item 210 into the interior space of the container 212.

Once the item 210 has been placed into the interior space of the container 212, the minor flaps 212-2 are moved or folded to a closed position that at least partially covers the access to the interior space of the container. Likewise, the major flaps 212-1 are moved or folded to a closed position that covers the minor flaps 212-2 and forms a top over the interior space thereby hindering or prohibiting access to the interior space 214 of the container. The major flaps are then sealed or otherwise secured to the container. For example, packing tape, glue or other adhesive material may be used to secure the major flaps to the sides of the container and/or to the minor flaps so that the top of the container formed by the flaps remains sealed.

In some implementations, the packing station 250 may include one or more imaging elements 213, such as digital cameras, video cameras, depth cameras, etc. The imaging elements may obtain one or more images of the interior space of the container as the item is packed and before the flaps of the container are closed, sealing the container. In such an implementation, the obtained images may be provided to the dunnage management system 255, which may operate on one or more computing resources 251, which may be local or remote computing resources. The dunnage management system 255, may process the images to determine, among other information, a size and dimensions of the container, a size and dimensions of the item placed into the interior space of the container, a position of the item within the interior space of the container, and approximate amount of interior space that is not filled (i.e., void) by the item, etc.

As discussed below, such information may be used to determine an injection point, an angle of the injector, a volume of gas to be expelled, an amount of dunnage to expel, a pressure of gas to be achieved, etc.

The computing resources 251 may form a portion of a network-accessible computing platform implemented as a computing infrastructure of processors, storage, software, data access, and other components that is maintained and accessible via a network 253. The packing station 250, imaging elements 213, routing operations, dunnage injection station 260, labeling station 261, etc. may communicatively couple to the computing resources 251 via the network 253 which may represent wired technologies (e.g., wires, USB, fiber optic cable, etc.), wireless technologies (e.g., RF, cellular, satellite, Bluetooth, etc.), and/or other connection technologies.

As illustrated, the computing resources 251 may include one or more servers, such as servers 251(1), 251(2), . . . , 251(N). These servers 251(1)-(N) may be arranged in any number of ways, such as server farms, stacks, and the like that are commonly used in data centers. Furthermore, the servers 251(1)-(N) may include one or more processors and memory which may store the dunnage management system 255. An example computing system is discussed in further detail below with respect to FIG. 7.

The container 216, packed and sealed with, for example tape 217, is routed to a dunnage injection station 260. At the dunnage injection station 260, an insertion point 222 where an injector 220 is to penetrate a perimeter of the container 216 is determined. In some implementations, the container may already include a defined insertion point 222 that is preformed to receive the injector. In other implementations, the insertion point may be selected along the length of a side of the container. For example, in some implementations, the insertion point may be made within the top 10% of the surface area of a long side surface of the container 216. In other implementations, the insertion point may be in a seam formed by the major flaps, or in a seam formed between a major flap and a minor flap. In still another example, the insertion point may be between the two major flaps, or through a mid-point in a major flap of the sealed container 216.

In implementations in which the dunnage management system 255 received images of the interior space of the container prior to the container being sealed, the images may be processed to determine an area of the container where the item is not positioned, thereby reducing any potential that the injector will contact the item when it penetrates into the interior space of the container. For example, if the item is placed in one end of the container, the insertion point may be determined to be on an opposing end of the container, away from the packed item. Alternatively, if the item is packed toward the middle of the container, the insertion point may be selected to be on either side of the container where the voids remains in the interior space. In some implementations, as discussed below, multiple insertion points may be determined and the injector, or multiple injectors, may be used to penetrate the container at each of the determined insertion points.

Upon determination of an insertion point, the injector 220 penetrates the container at the insertion point 222 until the tip of the injector protrudes into the interior space of the container 216. The amount of the protrusion may vary based on the configuration of the injector, the container, and/or the items included in the container. For example, the injector 220 may be inserted such that it extends approximately 3.0 millimeters (mm) into the interior space of the container when inserted. In other implementations, the injector 220 may be inserted such that it extends further or less into the interior space.

Upon insertion, a gas is expelled through a nozzle positioned within an interior of the injector. A force of the expelled gas causes dunnage to expel from the interior of the injector and into the interior space of the cavity. As the dunnage is expelled, it is filled with the expelled gas, expanding and filling at least a portion of the void within the interior space of the container that is not filled by the item that was packed and sealed within the container. In some implementations, multiple injectors may be inserted into different injection points on the container, each expelling gas and filling dunnage within the interior space of the container 216. In other examples, the same injector may be used to inject and fill dunnage into multiple voids within the container.

As the gas is expelled, a volume expelled, pressure of the expelled gas as measured by a pressure gauge 223, and/or an amount of expelled dunnage may be monitored to determine if the expelled dunnage should be sealed and separated from dunnage that has not been expelled. For example, once a defined amount of dunnage (e.g., 10 centimeters (cm)), and/or a defined volume of gas (e.g., 750 $cm^3$) has been expelled, the dunnage may be sealed thereby entraining the gas in the expelled dunnage and forming a gas-filled pouch of dunnage within the interior space of the container. The injector may also separate the gas-filled pouch of dunnage from bulk dunnage that has not been expelled from the injector. Alternatively, the injector may not separate the gas-filled pouch and instead expel additional gas from the nozzle of the injector. As additional gas is expelled, additional dunnage is expelled into the container and filled with the additional gas, thereby filling additional portions of the void within the interior space of the container.

Once a defined additional amount of gas has been expelled, a pressure of the additional expelled gas reached, and/or an amount of additional dunnage expelled, the additional dunnage may be sealed and/or separated from the bulk dunnage that has not been expelled from the injector, thereby forming an additional gas-filled pouch within the interior space of the container. This processes of expelling gas and dunnage into the container and sealing the dunnage to form a gas-filled pouch may be repeated a defined number of times and/or until a defined pressure is reached while expelling gas. For example, gas-filled pouches of dunnage may continue to be formed into the interior space of the container until a defined pressure of expelled gas is achieved. Alternatively, rather than forming multiple gas-filled pouches of dunnage within the interior space, a single gas-filled pouch of dunnage may be filled with gas and allowed to expand until a desired gas pressure is reached. The pressure of expelled gas will increase as the expelled dunnage expands and presses against an interior surface of the container, the item, and/or against other gas-filled pouches of dunnage already formed in the container. The defined pressure may be any pressure (e.g., 1-2 pounds per square inch (psi)) and may be determined based on, for example, the dimensions of the gas-filled pouch, the anticipated void within the interior space of the container, the dimensions of the container, the item, etc.

After one or more gas-filled pouches of dunnage have been formed within the container 216, it is determined that additional dunnage is not needed. When determined, the last expelled amount of dunnage is sealed and separated from bulk dunnage that has not been expelled from the injector, the injector 220 is removed from the container, and the container is routed to labeling operations 261. At the labeling operations 261, one or more shipping labels 232, such as a destination address for the packed item, are affixed to the packed, filled, and dunnage injected container 230. In some implementations, if the injector 220 formed a hole in a surface of the container 230, the label may be applied over the hole, as illustrated in FIG. 2. In other implementations, the labeling operations 261 may apply a shipping label at a first location on the container 230 and apply another label, or patch, over a hole formed by the injector 220.

Finally, after the container has been packed with the item, sealed, dunnage injected after the container was sealed, and labeled, the container is routed to shipping or other operations for additional processing.

Figure 3A:
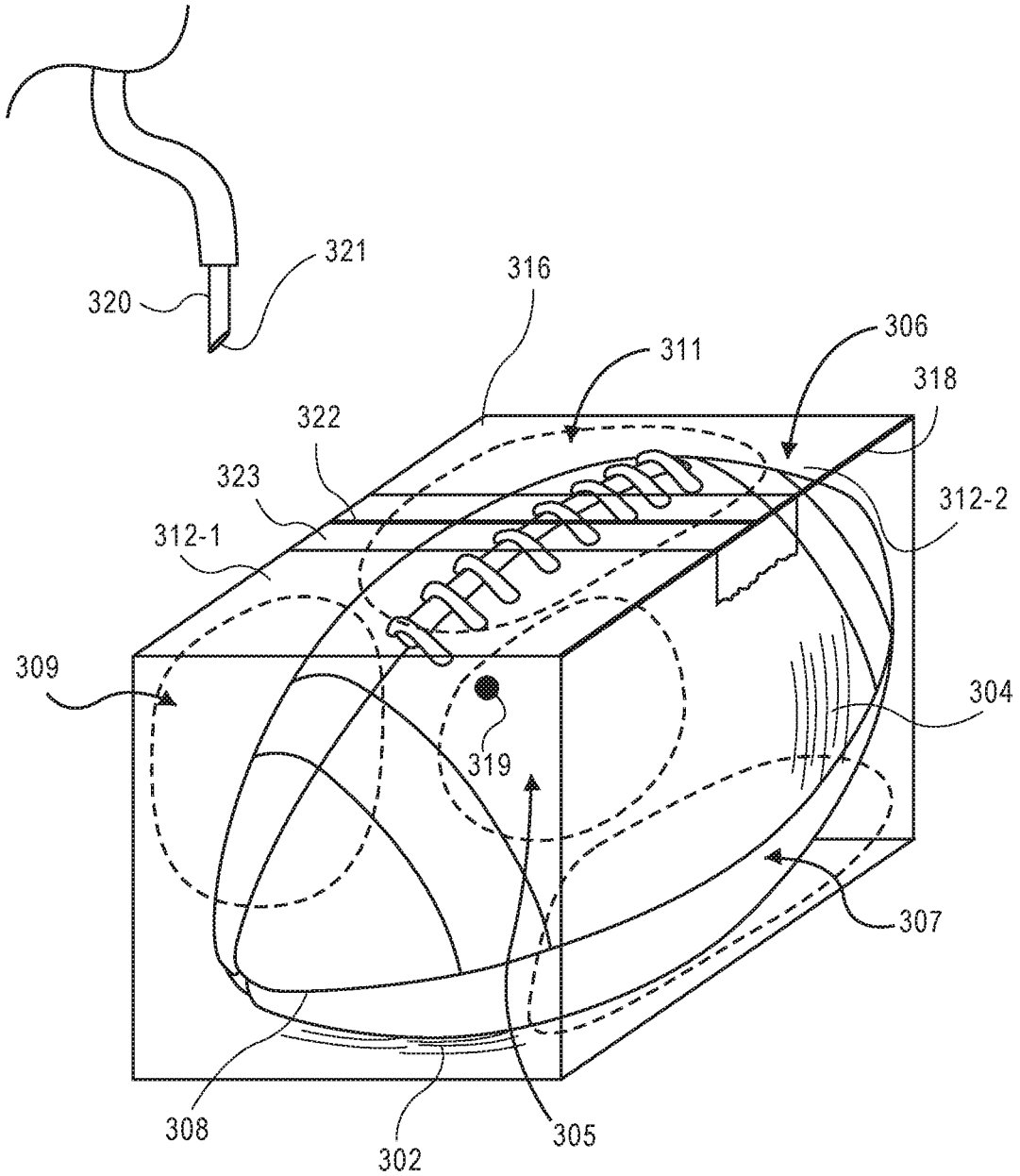
FIG. 3A illustrates an example of a packed and sealed container into which dunnage may be injected, according to an implementation.

FIG. 3A illustrates an example of a packed and sealed container into which dunnage may be injected, according to an implementation. As discussed above, the container 316 includes a bottom surface 302, one or more side surfaces 304 that are affixed to and extend from the bottom surface thereby forming an interior space 306 into which an item 308 is placed. In this example, the container 316 also includes flaps 312 that may be moved between an open position and closed position. When the flaps are in the open position, access to the interior space 306 is available and the item 308 is placed into the interior space through the open top of the container 316. After the item is placed into the interior space, the flaps 312 are moved to the closed position, as illustrated, thereby forming a top surface to the container and prohibiting access to the interior space of the container and/or the item. To seal the flaps in the closed position, tape 323, glue, and/or other adhesive is applied.

Once the item is packed in the container 316 and the container is sealed, one or more insertion points are determined at which the injector 320 penetrates the container. In some implementations, the container 316 may include a pre-formed insertion point 319 that is sized to receive the injector 320. For example, the insertion point 319 may be a preformed hole, a grommet, a flexible membrane, or the like, through which the injector 320 may penetrate the perimeter of the container 316 and access the interior space 306 within the sealed container.

In other implementations, an insertion point may be determined and the injector 320 may penetrate through the perimeter surface of the container 316 at the determined insertion point. For example, the tip 321 of the injector 320 may include a cutting edge and/or heating element that can be used to penetrate a surface of the packed and sealed container 316 and/or burn a hole into the surface of the container 316 so that the injector 320 can access the interior space 306 of the container 316.

In other examples, rather than cutting or burning a hole through a surface of the container, the insertion point may be at a seam between two or more flaps of the sealed container 316. For example, the two flaps 312-1, 312-2, when placed in the closed position and sealed, form a seam 322. The insertion point may be at a position along the seam between the two flaps 312-1, 312-2 and the tip 321 of the injector 320 may penetrate the sealed container 316 at a point in the seam 322 formed between the two flaps. In such a configuration, the injector can access the interior space of the container 316 without puncturing the perimeter of the container. If the flaps 312 are sealed with tape, the tip 321 of the injector 320 may pierce the tape and enter the interior space of the container as it passes through the seam between the two flaps. When the injector is extracted, additional tape, other adhesive, a label, or other covering may be applied over any remaining hole.

As still another example, as discussed below, the injector may be shaped so that it can pass through a side seam 318 formed between flaps of the container when the container is sealed. As discussed above with respect to FIG. 2, the container may include minor flaps (identified as 212-2 in FIG. 2) and major flaps 312. When the container is closed and sealed, as illustrated in FIG. 3, the minor flaps are moved to a closed position first and then the major flaps are moved to a closed position over the minor flaps, thereby forming a seam 318 along a top edge of the container 316 between the minor flaps and the major flaps. In such an example, the injector 320 may be inserted in the seam 318 formed between the major flap 312 and the minor flap to access the interior space 306 of the packed and sealed container 316.

After the injector 320 is inserted into the container 316 and accesses the interior space 306 within the container 316, gas and dunnage are expelled through the injector into voids within the interior space of the container such that the gas fills the dunnage, forming one or more gas-filled pouches of dunnage within the interior space of the container. Voids, such as voids 307, 309, and 311 are areas within the interior space of the container 316 that are not filled by the item 308 placed within the container 316.

In some examples, the location of the voids within the interior space 306 of the container 316 may be estimated based on a known size and shape of the container and/or a known size and shape of the item(s) placed into the container. In other examples, the location of the voids within the interior space 306 of the container 316 may be approximated based on image information obtained during packing of the item into the container. For example, as discussed above, one or more images of the item positioned within the container may be obtained during packing operations before the container is closed and sealed. The images may be processed using one or more image processing algorithms, such as an edge detection algorithm, object detection algorithm, etc. to determine an approximate position of the item within the container. Based on the approximate position of the item within the container, the locations of the voids are identified.

In some examples, it may be assumed that at least an upper percentage of the interior space of the container, an area between a top of the item and the inner surface of the top of the container after the container has been closed and sealed includes a void. In the illustrated example, it may be assumed that approximately five percent of the upper area of the interior space of the container is a void 311.

Based on the estimated or approximate location of voids within the container, one or more insertion points are determined and the injector 320 is inserted into the container at those insertion points so that dunnage can be injected into and fill at least a portion of the voids within the container 316.

Figure 3B:
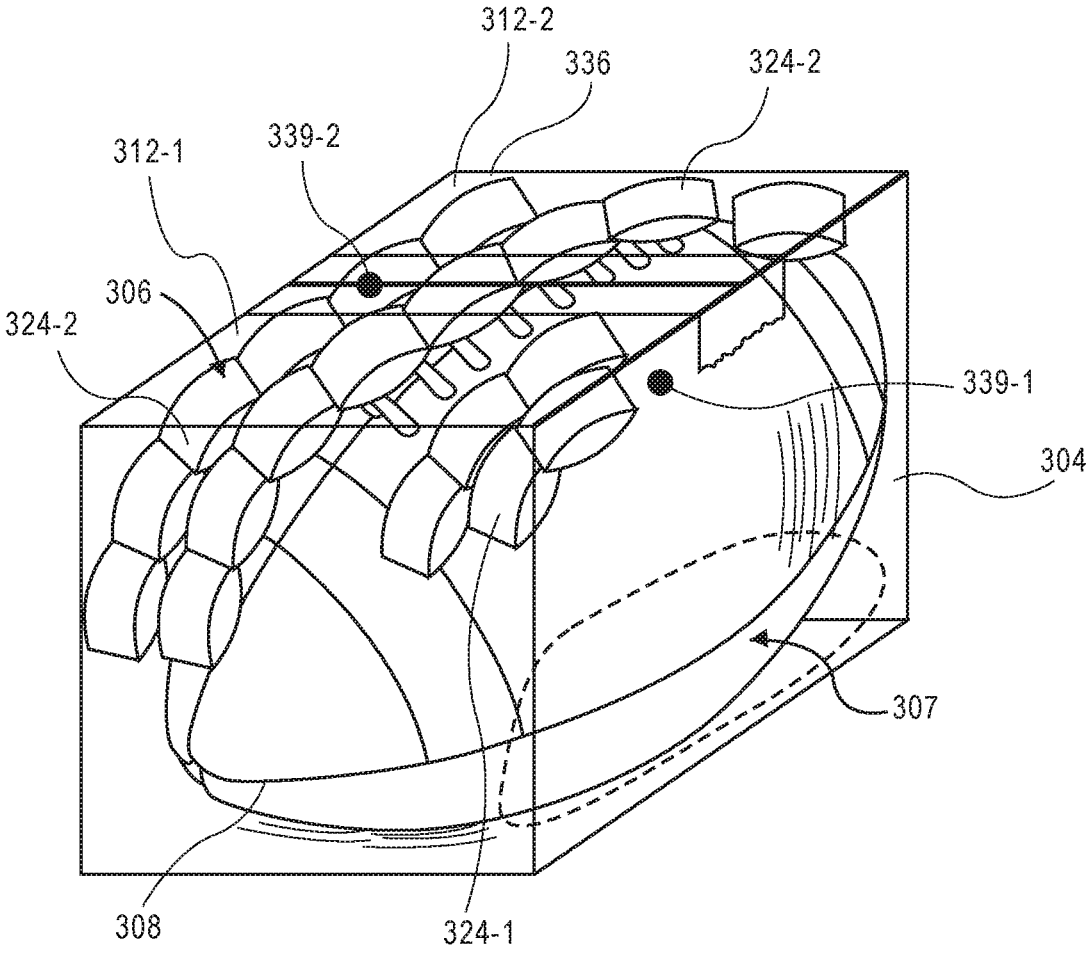
FIG. 3B illustrates the packed and sealed container of FIG. 3A after dunnage has been injected into the interior space of the container, according to an implementation.

FIG. 3B illustrates the packed and sealed container 336 of FIG. 3A after dunnage 324, in the form of gas-filled pouches, has been injected into the interior space 306 of the container 336, according to an implementation. In the illustrated example, the injector was inserted at two different insertion points. First, the injector was inserted through the side surface 304 at insertion point 339-1 and injected dunnage 324-1 to fill a portion of the void 305 illustrated in FIG. 3A within the interior space 306 of the sealed container. Second, the injector was inserted at insertion point 339-2 in the seam formed between flaps 312-1 and 312-2 and injected dunnage 324-2 to fill a portion of the void 311 and void 309, both illustrated in FIG. 3A, within the interior space of the container 316.

When the injector was inserted through insertion point 339-1, it injected gas and dunnage that formed five gas-filled pouches 324-1. In other implementations, a single gas-filled pouch may be formed to fill at least a portion of the void 305 (FIG. 3A). When the injector was inserted through the insertion point 339-2 it was first inserted at an angle toward the void 309 (FIG. 3A) and injected gas and dunnage that formed the gas-filled pouches that filled at least a portion of the void 309. After determining that a sufficient amount of dunnage 324 had been injected to fill the void 309, the angle of the injector was altered such that the gas and dunnage injected into the container 336 filled at least a portion the void 311 (FIG. 3A) between the top of the item 308 and the interior surface of the top of the container 336 formed by the closed flaps 312.

By filling portions of voids within the interior space of the container between the item and the interior of the container with dunnage, the dunnage secures the item within the container so that the item does not shift within the container during transport. In this example, the dunnage injected into and filling the void 305 (FIG. 3A) secures the item 308 so that the item does not move laterally within the container 336. Specifically, in this example, the item is secured between the side surfaces on one side of the item and the injected dunnage fills the void securing the item with the dunnage and the other side surfaces of the container. Likewise, the dunnage injected into and filling the voids 309 and 311 secure the item 308 so that the item does not move vertically within the container. Specifically, in this example, the item 308 is secured between the bottom surface upon which it is resting and held by the injected dunnage 324-2 that fills the void between the item 308 and the interior surface of the top of the container 336.

Notably, not all voids within the container need be filled to secure the item during transport. In this example, the void 307 within the interior space of the container 336 was not filled with dunnage because it was determined that sufficient dunnage had been injected to secure the item 308 within the container. In other implementations, dunnage may be injected into all voids within a sealed container. Injecting dunnage into all voids of a sealed container may be beneficial for oddly shaped items, fragile items, etc. Likewise, if the dunnage is filled with a lighter than air gas, the dunnage may be injected in all voids to reduce the total weight of the container, thereby potentially lowering a transportation cost of the container.

Figure 4:
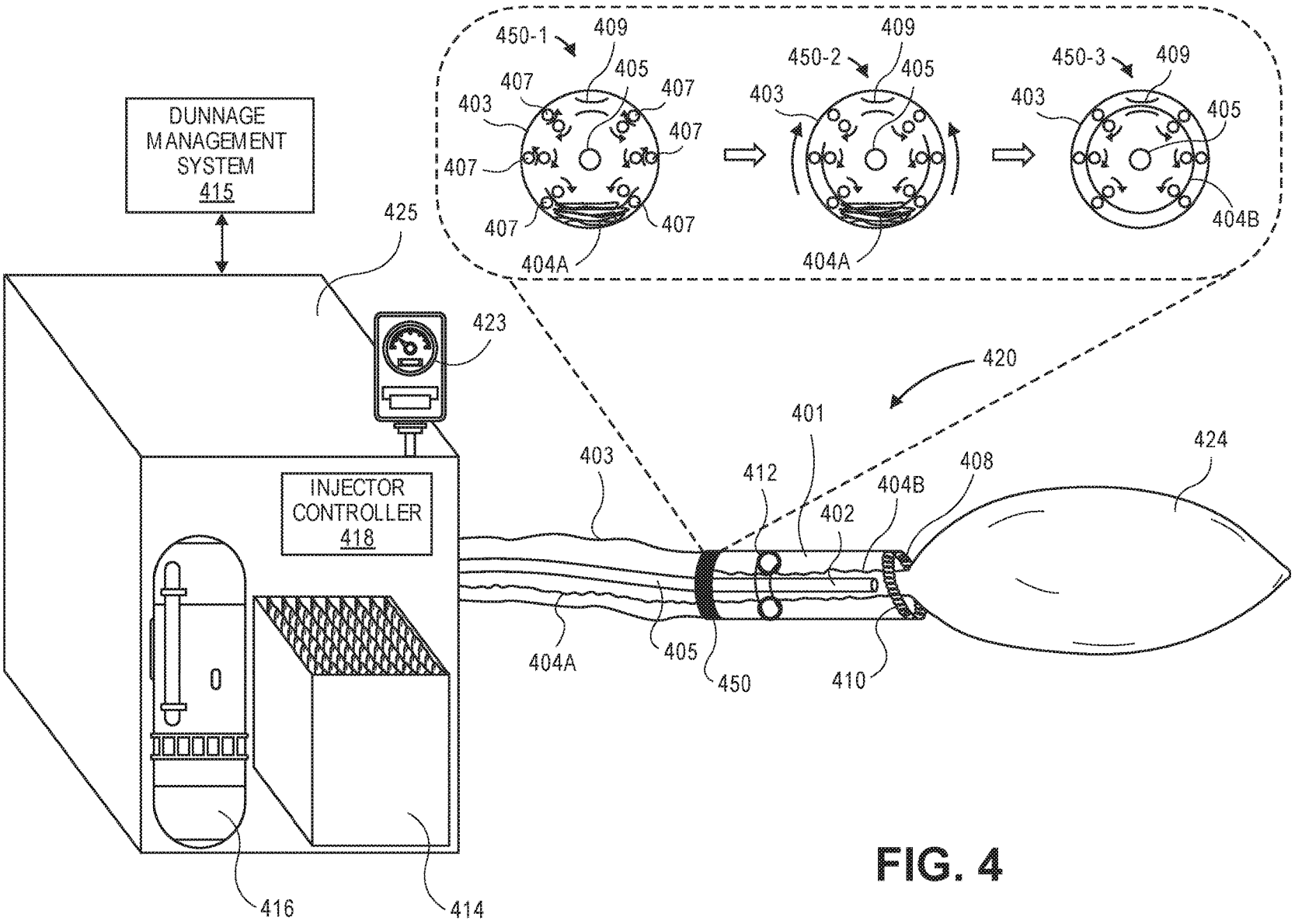
FIG. 4 illustrates an example dunnage injection apparatus, according to an implementation.

FIG. 4 illustrates an example dunnage injection apparatus 420, according to an implementation. As discussed above, the dunnage injection apparatus 420 includes an injector 401 that penetrates a perimeter of a container and into an interior space of the container. The injector includes a tip 408 that may include a cutting edge that can cut through a surface of the container. Alternatively, the tip may include a heating coil that can be energized to burn a hole in the edge of a container to create an insertion point through which the injector may enter the interior surface of a container. As discussed further below, the shape of the injector 401 may vary.

Generally described, the injector 401 has a hollow body that includes an outer perimeter and an open inner space. A gas nozzle 402 is recessed in the open inner space. The gas nozzle is hollow with an open tip such that a gas from a gas supply 416 can be expelled out of the open end of the nozzle 402. The nozzle may be recessed from the tip 408 so it is not potentially damaged as the tip penetrates the surface of a container.

In addition to the gas nozzle 402, the open inner space of the injector 401 includes a dunnage feed through which dunnage 404B passes through the injector and out of the open tip 408 of the injector. In some implementations, the dunnage feed may include a dunnage roller 450 and/or one or more friction rollers 412. As illustrated in the expanded view, the dunnage roller may include a series of rollers or wheels 407 that receive a sheet of bulk dunnage 404A and roll the sheet of bulk dunnage 404A up and around the gas nozzle 402. For example, as illustrated by the detail view of dunnage roller 450-1, a sheet of bulk dunnage 404A may be fed into the first set of wheels 407 that are positioned within the dunnage roller 450. The wheels 407 may rotate to draw the sheet of dunnage up and around the gas nozzle 402, as illustrated in the progressive detail views 450-2 and 450-3. When the bulk dunnage has been rolled up and around the gas nozzle 402, the two ends of the sheet of bulk dunnage 404A are bonded or joined together with a joiner 409, thereby forming substantially tubular dunnage 404B. Bonding of the two ends of the sheet of bulk dunnage 404A may be done by heating the ends of the dunnage, by applying an adhesive to the ends of the dunnage by the joiner 409, through use of an adhesive that is already prepared on one or both ends of the dunnage 404A, through a chemical bonding process, or the like. The bulk dunnage 404B, once formed as a tubular dunnage around the gas nozzle 402 continues into the injector 401.

The friction rollers 412 may be activated or deactivated to control the rate at which the dunnage 404B is expelled from the injector 401 and into an interior space of a sealed container and/or to feed the dunnage through the dunnage roller 450 and into the injector 401. For example, the friction rollers may slow or stop expulsion of the dunnage 404B as gas is expelled through the nozzle such that the gas fills and expands the dunnage to form a gas-filled pouch of dunnage 424, as illustrated. Alternatively, the friction rollers 412 may be released to allow the dunnage to be expelled as the gas is expelled from the nozzle 402 and allow the expelled dunnage to fill the voids within the interior space of a container into which the injector 401 has been inserted.

In one example, the dunnage 404B is a flexible, tubular polymer material that surrounds the nozzle 402. As the gas is expelled from the tip of the nozzle 402, the gas is expelled into an interior of the dunnage 404B, thereby causing the dunnage 404B to fill with gas and be expelled through the open tip of the injector. As the dunnage is expelled, additional sheet form dunnage 404A is provided from bulk dunnage 414 of the dunnage injection apparatus 420, rolled by the dunnage roller 450 to form tubular dunnage that surround the gas nozzle 402 and fed through the injector 401.

To form the gas-filled pouches of dunnage 424, a sealer and/or cutting element 410 may be included toward the end of the tip 408 of the injector 401. For example, the injector may include a combination sealer/cutter element 410 in the form of a flexible memory metal that extends around the perimeter of the interior of the open tip 408 of the injector 401. In such an implementation, the sealer/cutter element 410 is positioned around the open inner space within the injector 401 such that it is external to and surrounds the dunnage 404B. Likewise, the sealer/cutter element 410 is positioned toward the tip 408 of the injector at a point past the nozzle 402. When the flexible memory metal is heated, the heat from the metal causes the polymer dunnage to liquefy thereby sealing the end of the dunnage 404B together. Likewise, as the flexible memory metal is heated, it contracts together separating two portions of the liquefied polymer dunnage so that the dunnage expelled from the tip of the injector 401 is sealed with a liquefied portion of the dunnage. The liquefied portion will rapidly cool when separated thereby entraining the gas inside the gas-filled pouch. Likewise, a second portion of the dunnage that is interior to the injector will be sealed by the merging of the liquefied dunnage at a point between the sealer/cutter element 410 and the nozzle 402. As such, the leading edge of the next portion of the dunnage to be expelled from the injector 401 is sealed. When gas is expelled from the nozzle 402 it will fill the sealed dunnage, thereby causing the sealed dunnage to expel from the open end of the injector and into a container. Other examples of a sealer element include a Tungsten wire that may be heated to liquefy the dunnage, a resistive heating element, an induction heating element, a high intensity ultrasound welding element, and/or the sealing can be accomplished using a local exothermic chemical reaction.

In other implementations, the injector 401 may include separate sealing and cutting element. For example, the injector 401 may include a mechanical press that presses and seals an end of the dunnage together to entrain the gas within the gas-filled pouch of dunnage 424. Likewise, a mechanical cutter may be included to cut or separate a portion of the dunnage that has been expelled from the injector 401 from dunnage that has not been expelled from the injector 401.

The injector 401 is coupled to a control station 425 by an outer flexible tube 403 and an inner flexible tube 405. The dunnage 404A is fed from bulk dunnage 414 inside the outer flexible tube 403 to the dunnage roller 450 and rolled around the gas nozzle 402 to form the tubular dunnage 404B that is fed into the injector 401. The inner flexible tube 405 terminates at the gas nozzle and a gas from a gas supply 416 is passed through the inner flexible tube and out through the tip of the nozzle 402.

In some implementations, rather than using a solid flexible dunnage 404A material that is fed to the dunnage roller 450 and wrapped around the gas nozzle 402 to form the tubular dunnage 404B, as discussed above, the dunnage may be a material that is in a liquid state when heated above a defined temperature (e.g., above 30 degrees Celsius) and a solid state when at or below the defined temperature. In such an example, the dunnage may be heated by the dunnage apparatus 425 such that it will, in the liquid state, pass through the interior of the outer flexible tube 403 and surround the inner flexible tube 405. In such an example, the dunnage may remain heated while in the outer flexible tube 403 and/or in the injector 401 until it is expelled out of the end of the injector.

For example, the end of the injector 401 may include a cooling element that will cause the dunnage to rapidly cool and change states from a liquid state to a solid state. The solid dunnage is then expelled out of the end of the injector 401 as the gas is expelled from the gas nozzle 402 to form a gas-filled pouch of dunnage within the container. In such a configuration, rather than heating the dunnage at the end of the injector to seal and separate the dunnage, the dunnage may be cooled so that the dunnage changes states from liquid to solid that can be separated from the expelled dunnage. The solid dunnage at the end of the injector that is separated from the expelled dunnage forms a cap over the end of the injector that provides protection for components of the injector (e.g., the gas nozzle 402). Likewise, because the solid form of the dunnage forms a cap over the gas nozzle 402, when additional gas is expelled, the additional expelled gas will cause the solid dunnage cap to be expelled and the dunnage injector controller 418 of the dunnage apparatus may cause additional dunnage in liquid form to be expelled through the injector such that it will cool and change states to a solid form within the container, thereby forming an additional gas filled-pouch of dunnage within the container.

In some implementations, the expelled dunnage, when it changes from a liquid to a solid may be a rigid solid such that the end of the dunnage does not need to be sealed to entrain the gas to form the gas-filled pouch. In contrast, the solid, rigid material will maintain shape within the container. In other implementations, the dunnage may be a flexible material when in the solid state. In such an implementation, the end of the dunnage may be sealed and separated using techniques similar to those discussed herein.

The control station 425 may also include an injector controller 418, which may include software and/or hardware components, that monitor an amount of expelled dunnage, an amount of expelled gas, and/or a pressure of the expelled gas. For example, the control station 425 may include a pressure gauge 423 that monitors a pressure of gas expelled into and filling a gas-filled pouch of dunnage 424. Alternatively, or in addition thereto, the injector controller may monitor a feed rate of the dunnage expelled from the injector and decrease or increase the feed rate of the dunnage by controlling the friction rollers 412.

In some implementations, the injector controller 418 may also be used to determine the one or more insertion points and/or to determine an alignment or orientation of the injector 401 when it penetrates into the interior space of a container. Alternatively, the control station 425 may communicate with and/or be controlled by a dunnage management system 415 that provides information to the control station 425. For example, the dunnage management system 415 may provide container dimension information and/or item dimension information to the injector controller 418 and the injector controller may determine the one or more injection points and/or an amount of dunnage, gas, or gas pressure for forming the gas-filled pouches of dunnage 424. Alternatively, the dunnage management system 415 may provide all information to the injector controller 418 and the injector controller may be configured to control the operation of the dunnage injection apparatus 420. As will be appreciated, the arrangement, configuration, and communication between the control station 425 and the dunnage management system 415 may vary. The implementations described herein cover all such configurations independent of whether or where certain aspects, such as insertion points, injector alignment, dunnage amount to expel, volume of gas to expel, gas pressure to be achieved, etc., are determined.

In some implementations, rather than causing the dunnage to be expelled from the injector 401 in response to a gas being injected through the gas nozzle 402, a negative vacuum nozzle may be inserted into the container at a second insertion point. In such an implementation, when both the injector 401 and the negative vacuum nozzle are inserted into the container, the negative vacuum nozzle extracts air from the interior of the container, which creates negative pressure that causes dunnage from the injector 401 to be drawn out of the end of the injector 401 and into the interior of the container. Likewise, gas, such as ambient air drawn through the injector 401, and/or gas expelled from the gas nozzle 402 will fill the dunnage to form a gas-filled pouch within the interior of the container. Because this implementation utilizes negative pressure, the gas nozzle 402 may be omitted from the injector, and ambient air may be drawn in with the dunnage that fills the dunnage to form the gas-filled pouch within the interior of the container.

Figure 5C:
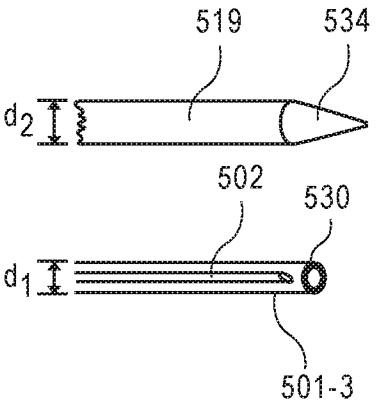
FIGS. 5A-5C illustrate example injectors that may be utilized with a dunnage injection apparatus, according to an implementation.
Figure 5B:
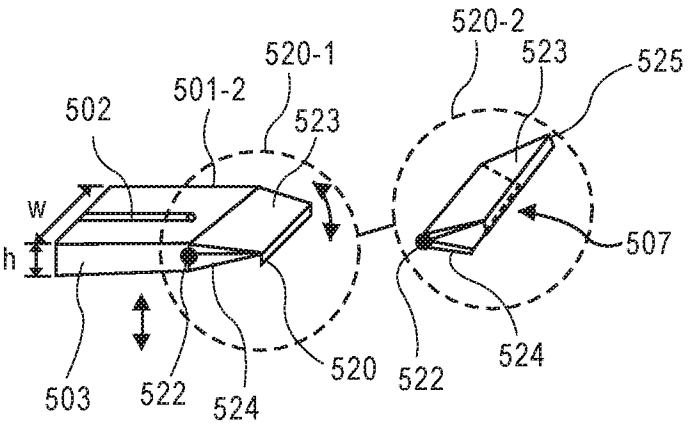
Figure 5A:
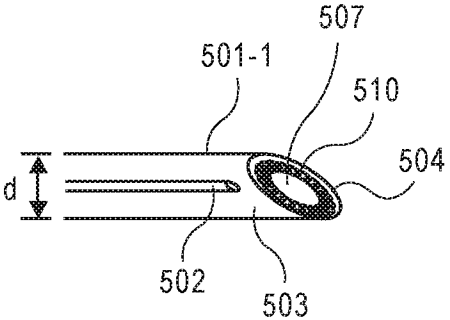

FIGS. 5A-5C illustrate example injectors 501 that may be utilized with a dunnage injection apparatus, according to an implementation. Turning first to FIG. 5A, illustrated is an injector 501-1, which is similar to the injector 401 discussed above with respect to FIG. 4. As illustrated, the injector 501-1 is substantially tubular with a rigid outer surface 503 that has an open inner space 507 that forms a hollow body with an open end. The leading edge 504, which extends beyond the other components of the injector, includes a sharp cutting edge that can be used to penetrate a surface of a container to gain access to an interior space of the container. Recessed into the open inner space of the injector 501-1, and just behind the leading edge is a sealer/cutter 510, formed of a flexible memory metal. As discussed above, the sealer/cutter 510 may be heated, thereby causing the dunnage proximate the sealer/cutter 510 to liquefy. Likewise, the memory metal of the sealer/cutter 510, when heated is configured to contract, thereby pressing the liquefied dunnage together, sealing an end of a gas-filled pouch of dunnage that has been expelled from the injector 501-1, sealing an end of the dunnage that has not been expelled from the injector, and causing the two portions of dunnage to separate such that the gas-filled pouch of dunnage is released from the dunnage that remains in the interior of the injector 501-1.

The diameter of the injector 501-1 may be of a size sufficient to allow enough inner space 507 such that the gas nozzle 502 and the dunnage can pass there through. For example, the diameter (d) of the injector may be approximately 7.5 millimeters (mm). In other implementations, the diameter of the injector 501-1 may be larger or smaller.

FIG. 5B illustrates an alternative configuration of an injector 501-2, according to an implementation. In this configuration, the injector has more of a rectangular, elongated shape, with a mechanical sealer/cutter 520 that may be moved between a closed position 520-1 and an open position 520-2. Similar to the injector 501-1, the injector 501-2 includes rigid outer surface 503 that has an open inner space 507. In this example, the tip of the injector 501-2 includes a claim-shell upper member 523 and lower member 524 that are coupled at hinges 522 so that the upper member 523 and lower member 524 may be moved between the closed position 520-1 and the open position 520-2.

When the upper member 523 and the lower member 524 are in a closed position, the tip forms a closed wedge shape that protects the other components of the injector, such as the nozzle 502. Likewise, when in the closed position the wedge shape facilities penetration into the container at an insertion point. The example, injector 501-2 is particularly useful when the insertion point is at a seam between two flaps of the container and the injector penetrates the container by being inserted in the seam between the two flaps of the container.

Once the injector 501-2 is positioned within the interior space of the container, the upper member 523 and the lower member 524 rotate about the hinges 522 to the open position 520-2 thereby exposing the open inner space of the injector 501-2 so that gas can be expelled through the nozzle 502 and dunnage can be expelled from the open end of the injector and into the interior space of a sealed container, as discussed herein. Likewise, one or both of the upper member 523 and lower member 524 may include a sealer/cutter 525. When an end of the dunnage is to be sealed and/or cut, the upper member 523 and lower member 524 rotate about the hinges 522, thereby compressing and sealing expelled dunnage where the edge of the upper member 523 and lower member 524 meet when in the closed position 520-1. The edge of the upper member 523 and lower member 524 may include a press to seal the dunnage, may include a sharp and/or serrated edge to cut the dunnage and/or may include a heating element to liquefy the dunnage so that dunnage on either side of the edge of the upper member 523 and lower member 524 are sealed and separated when the upper member 523 and lower member 524 are in the closed position 520-1.

The height (h) and width (w) of the injector 501-2 may be of a size sufficient to allow enough inner space 507 such that the gas needle 502 and the dunnage can pass there through. For example, the height (h) of the injector 501-2 may be approximately 6.0 mm and the width may be approximately 14.0 mm. In other implementations, the height and/or width of the injector 501-2 may be larger or smaller.

FIG. 5C illustrates yet another example injector 501-3, according to an implementation. In this example, the injector 501-3 may be used in conjunction with a probe 519. The probe 519 may be a solid material that includes a pointed tip 534. The probe 519 is used to puncture a surface of the container at an insertion point to create an opening so that the injector 501-3 can be passed through the opening and into an interior space of a container. The probe 519 may have a shape that is similar to the shape of the injector 501-3 so that once the opening is formed, the injector 501-3 will be able to pass through the opening. For example, if the injector 501-3 has a substantially tubular shape, as illustrated in FIG. 5C with a diameter ($d_1$), the probe 519 is also of a substantially tubular shape and may have a diameter ($d_2$) that is slightly larger than the diameter ($d_1$) of the injector 501-3. In such an example, the sealer/separator 530 may be positioned at the front edge of the injector because there is a reduced likelihood of any damage when the injector 501-3 is inserted into an already formed opening in the container. The gas nozzle 502 remains recessed from the front edge of the injector so that the dunnage that surrounds the nozzle may be sealed and separated at a location beyond the nozzle by the sealer/separator 530.

As will be appreciated, the injector may take a variety of shapes and sizes depending on the dunnage to be applied and/or the container into which the dunnage is to be injected. For example, smaller sized injectors may be used for smaller containers while larger injectors may be used to larger containers. Generally, the larger the injector the larger the amount of dunnage and gas that may be expelled over a period of time. However, the larger injector may leave a larger opening in the container once removed. Likewise, any configuration of injector may be used with a similarly sized and shaped probe, such as the probe 519 discussed with respect to FIG. 5C.

In some implementations, the dunnage injector apparatus, discussed above with respect to FIG. 4, may be configured such that different injectors may be utilized with the same apparatus. For example, the injectors may be removable from the flexible tubing 403, 405 (FIG. 4) so that different injectors may be used with the same apparatus.

Figure 6:
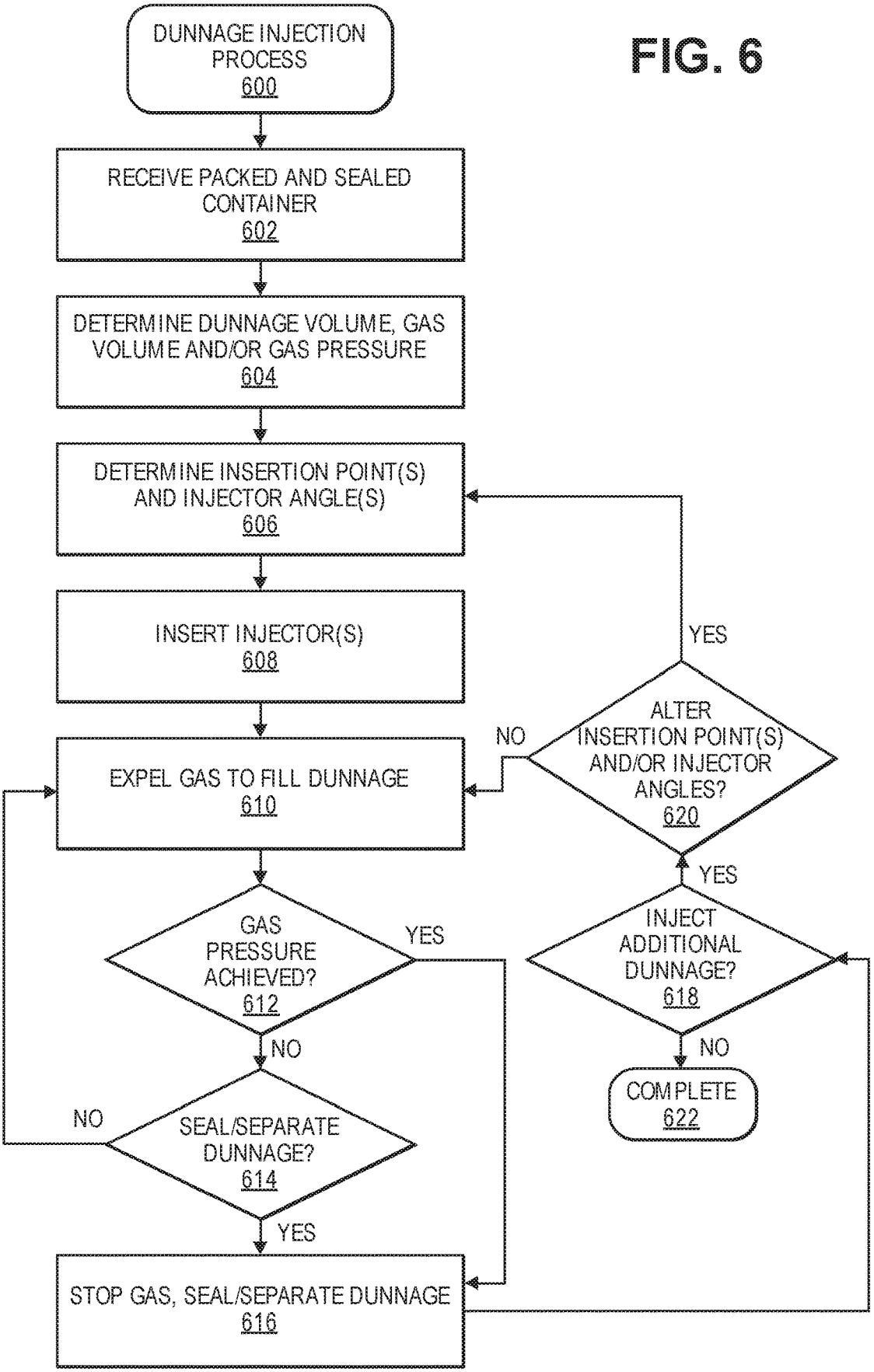
FIG. 6 is a flow diagram illustrating an example dunnage injection process, according to an implementation.

FIG. 6 is a flow diagram illustrating an example dunnage injection process 600, according to an implementation. The process is illustrated as a collection of blocks in a logical flow graph. Some of the blocks represent operations that can be implemented in hardware, software, or a combination thereof. In the context of software, the blocks represent computer-executable instructions stored on one or more computer-readable media that, when executed by one or more processors, perform the recited operations. Generally, computer-executable instructions include routines, programs, objects, components, data structures and the like that perform particular functions or implement particular abstract data types.

The computer-readable media may include non-transitory computer-readable storage media, which may include hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of storage media suitable for storing electronic instructions. In addition, in some implementations, the computer-readable media may include a transitory computer-readable signal (in compressed or uncompressed form). Examples of computer-readable signals, whether modulated using a carrier or not, include, but are not limited to, signals that a computer system hosting or running a computer program can be configured to access, including signals downloaded or uploaded through the Internet or other networks. Finally, the order in which the operations are described is not intended to be construed as a limitation, and any number of the described operations can be combined in any order and/or in parallel to implement the process. Likewise, additional or fewer operations than those described may be utilized with the various implementations described herein.

The example process 600 begins upon receipt of a packed and sealed container that contains an item, as in 602. The example process may be used with any size, shape and/or type of packed and sealed container. For example, the container may be a corrugated box that contains an item ordered by a customer of an electronic commerce website to be shipped to a customer specified destination.

Upon receipt of the sealed container, a dunnage volume, gas volume, and/or gas pressure that is to be injected into the container is determined, as in 604. The dunnage volume, gas volume, and/or gas pressure may be determined based on, for example, the dimensions and/or type of container, the dimensions and/or type of item, transportation information, customer preference, image analysis of one or more images obtained of an interior of the container after the item was placed into the container but before the container was closed and sealed, etc.

In one implementation, dunnage is to be applied in the form of gas-filled pouches that have a volume, when filled, of approximately 5 mm in width and 10 mm in length. In such a configuration, the feed rate of the dunnage is controlled so that expelled gas causes the desired length of dunnage to be expelled and generates a desired pressure (e.g., 1-2 psi) within the gas-filled pouch. Gas-filled pouches of dunnage may continue to be expelled and formed in the interior space of the container until the pressure of a gas-filled pouch reaches the desired pressure before the defined amount of dunnage has been expelled (i.e., the void within the interior space has filled with dunnage). In another example, an approximate volume of dunnage and/or gas may be determined based on the dimensions of the container and the item(s) placed in the container. For example, the difference between the dimensions of the container and the dimensions of the item may be computed as the approximate volume of empty space within the container that may be filled with injected dunnage.

The example process 600 also determines one or more insertion points into which one or more injectors are to be inserted into the container to access the interior space of the sealed container, as in 606. Likewise, an injector angle may also be determined, as in 606. In some implementations, the injection points may always be toward the top of the container, to reduce any potential impact between an item in the container and the inserted injector. In other implementations, the container may already include preformed insertion points. In still other examples, the insertion point(s) may be between seams formed by flaps of the container that were placed in a closed position to seal the container.

In some implementations, images of the interior of the container that were obtained after the item(s) was placed in the container may be analyzed to determine the approximate location of one or more voids within the container based on the placement of the item within the container. In such an example, the insertion point(s) may be proximate the voids within the interior space of the container. As noted above, in some implementations, not all the voids need be filled with dunnage. For example, only voids that will result in the item being secured within the container so that the item does not shift during transport may be selected to receive injected dunnage.

Upon determining one or more insertion points, an injector is inserted into the insertion point, as in 608. In some implementations, multiple injectors may be injected into the container at the same or similar times, each at a different insertion points and/or insertion angles. Examples of insertion of the injector such that it penetrates the surface of the container and enters the interior space of the container is discussed above.

When the injector is inserted into the container, gas is expelled through the nozzle within the interior of the injector which causes the dunnage within the interior of the injector that surrounds the nozzle to be expelled into the interior space within the container and become filled with the gas, as in 610. As the gas is expelled, a determination is made as to whether the desired gas pressure has been achieved, as in 612. For example, if the desired pressure for a gas-filled pouch of dunnage is not to exceed 2 psi, it may be determined whether the current pressure of the expelled gas has reached that determined pressure.

If it is determined that the gas pressure has not been achieved, a determination is made as to whether the dunnage is to be sealed and/or separated, as in 614. For example, even if the desired gas pressure has not been achieved, it may have been determined in block 604 that each gas-filled pouch of dunnage is to be of a defined length and/or contain a defined volume of gas. In such an example, if the defined length of dunnage and/or defined volume of gas has been expelled, it may be determined that the dunnage is to be sealed and, optionally, separated.

If it is determined that the dunnage is not to be sealed and/or separated, the example process 600 returns to block 610 and expulsion of the gas continues. However, if it is determined at decision block 612 that the gas pressure has been achieved or it is determined at decision block 614 that the dunnage is to be sealed and/or separated, the expulsion of the gas is stopped and the dunnage that has been expelled from the injector is sealed and separated at the tip of the injector such that the dunnage that has been expelled from the injector is sealed and the gas is entrained within the dunnage forming a gas-filled pouch, as in 616. As discussed above, the sealing and separation of dunnage that has been expelled from the injector also results in the end of the dunnage within the injector to be sealed so that it can be filled with gas and expelled from the injector, thereby forming another gas-filled pouch of dunnage.

After sealing and separating the dunnage, a determination is made as to whether additional dunnage is to be injected into the interior space of the container, as in 618. If it is determined that additional dunnage is to be injected, a determination is made as to whether the insertion point and/or the angle of insertion of the injector is to be altered, as in 620. For example, after each air-filled pouch of dunnage is formed within the interior space of the sealed container, the angle of the injector may be altered by a defined amount (e.g., five degrees) so that the next air-filled pouch of dunnage is formed out of line with the potential location of the prior air-filled pouch of dunnage. As another example, if the last air-filled pouch of dunnage was filled to the desired pressure, it may be determined that the injector is to be removed from the insertion point and inserted into another insertion point to expel and form gas-filled pouches in other voids within the interior space of the container.

If it is determined that the insertion point and/or the angle of insertion of the injector is to be altered, the example process 600 returns to block 606 and continues. If it is determined that the insertion point and/or the angle of insertion is not to be altered, the example process returns to block 610 and continues. Finally, if it is determined at decision block 618 that no additional dunnage is to be injected into the interior space of the sealed container, the example process 600 completes, as in 622.

While the example process and implementations describe injecting dunnage in the form of air-filled pouches into a sealed container to fill voids within the interior space of the container, in other implementations, other forms of dunnage may be injected into the interior space of the container through an injector that is inserted into the container after the item is packed in the container and the container is sealed. For example, dunnage in the form of paper, plastic particles, wood, rubber, foam, rapid setting pre-polymer, or the like may be expelled through the injector and into an interior space of a sealed container to secure and protect an item packed in the container.

Various operations of the systems, such as those described herein, may be executed on one or more computer systems, interacting with various other devices in a materials handling facility, according to various implementations. One such computer system is illustrated by the block diagram in FIG. 7. In the illustrated implementation, a computer system 700 includes one or more processors 710A, 710B through 710N, coupled to a non-transitory computer-readable storage medium 720 via an input/output (I/O) interface 730. The computer system 700 further includes a network interface 740 coupled to the I/O interface 730, and one or more input/output devices 750. In some implementations, it is contemplated that a described implementation may be implemented using a single instance of the computer system 700 while, in other implementations, multiple such systems or multiple nodes making up the computer system 700 may be configured to host different portions or instances of the described implementations. For example, in one implementation, some data sources or services (e.g., packing operations) may be implemented via one or more nodes of the computer system 700 that are distinct from those nodes implementing other data sources or services (e.g., dunnage management system).

In various implementations, the computer system 700 may be a uniprocessor system including one processor 710A, or a multiprocessor system including several processors 710A-710N (e.g., two, four, eight, or another suitable number). The processors 710A-710N may be any suitable processor capable of executing instructions. For example, in various implementations, the processors 710A-710N may be general-purpose or embedded processors implementing any of a variety of instruction set architectures (ISAs), such as the x86, PowerPC, SPARC, or MIPS ISAs, or any other suitable ISA. In multiprocessor systems, each of the processors 710A-710N may commonly, but not necessarily, implement the same ISA.

The non-transitory computer-readable storage medium 720 may be configured to store executable instructions and/or data accessible by the one or more processors 710A-710N. In various implementations, the non-transitory computer-readable storage medium 720 may be implemented using any suitable memory technology, such as static random access memory (SRAM), synchronous dynamic RAM (SDRAM), nonvolatile/Flash-type memory, or any other type of memory. In the illustrated implementation, program instructions and data implementing desired functions, such as those described above, are shown stored within the non-transitory computer-readable storage medium 720 as program instructions 725 and data storage 735, respectively. In other implementations, program instructions and/or data may be received, sent or stored upon different types of computer-accessible media, such as non-transitory media, or on similar media separate from the non-transitory computer-readable storage medium 720 or the computer system 700. Generally speaking, a non-transitory, computer-readable storage medium may include storage media or memory media such as magnetic or optical media, e.g., disk or CD/DVD-ROM coupled to the computer system 700 via the I/O interface 730. Program instructions and data stored via a non-transitory computer-readable medium may be transmitted by transmission media or signals such as electrical, electromagnetic, or digital signals, which may be conveyed via a communication medium such as a network and/or a wireless link, such as may be implemented via the network interface 740.

In one implementation, the I/O interface 730 may be configured to coordinate I/O traffic between the processors 710A-710N, the non-transitory computer-readable storage medium 720, and any peripheral devices, including the network interface 740 or other peripheral interfaces, such as input/output devices 750. In some implementations, the I/O interface 730 may perform any necessary protocol, timing or other data transformations to convert data signals from one component (e.g., non-transitory computer-readable storage medium 720) into a format suitable for use by another component (e.g., processors 710A-710N). In some implementations, the I/O interface 730 may include support for devices attached through various types of peripheral buses, such as a variant of the Peripheral Component Interconnect (PCI) bus standard or the Universal Serial Bus (USB) standard, for example. In some implementations, the function of the I/O interface 730 may be split into two or more separate components, such as a north bridge and a south bridge, for example. Also, in some implementations, some or all of the functionality of the I/O interface 730, such as an interface to the non-transitory computer-readable storage medium 720, may be incorporated directly into the processors 710A-710N.

The network interface 740 may be configured to allow data to be exchanged between the computer system 700 and other devices attached to a network, such as other computer systems, or between nodes of the computer system 700. In various implementations, the network interface 740 may support communication via wired or wireless general data networks, such as any suitable type of Ethernet network.

Input/output devices 750 may, in some implementations, include one or more displays, projection devices, audio output devices, keyboards, keypads, touchpads, scanning devices, voice or optical recognition devices, or any other devices suitable for entering or retrieving data by one or more computer systems 700. Multiple input/output devices 750 may be present in the computer system 700 or may be distributed on various nodes of the computer system 700. In some implementations, similar input/output devices may be separate from the computer system 700 and may interact with one or more nodes of the computer system 700 through a wired or wireless connection, such as over the network interface 740.

Figure 7:
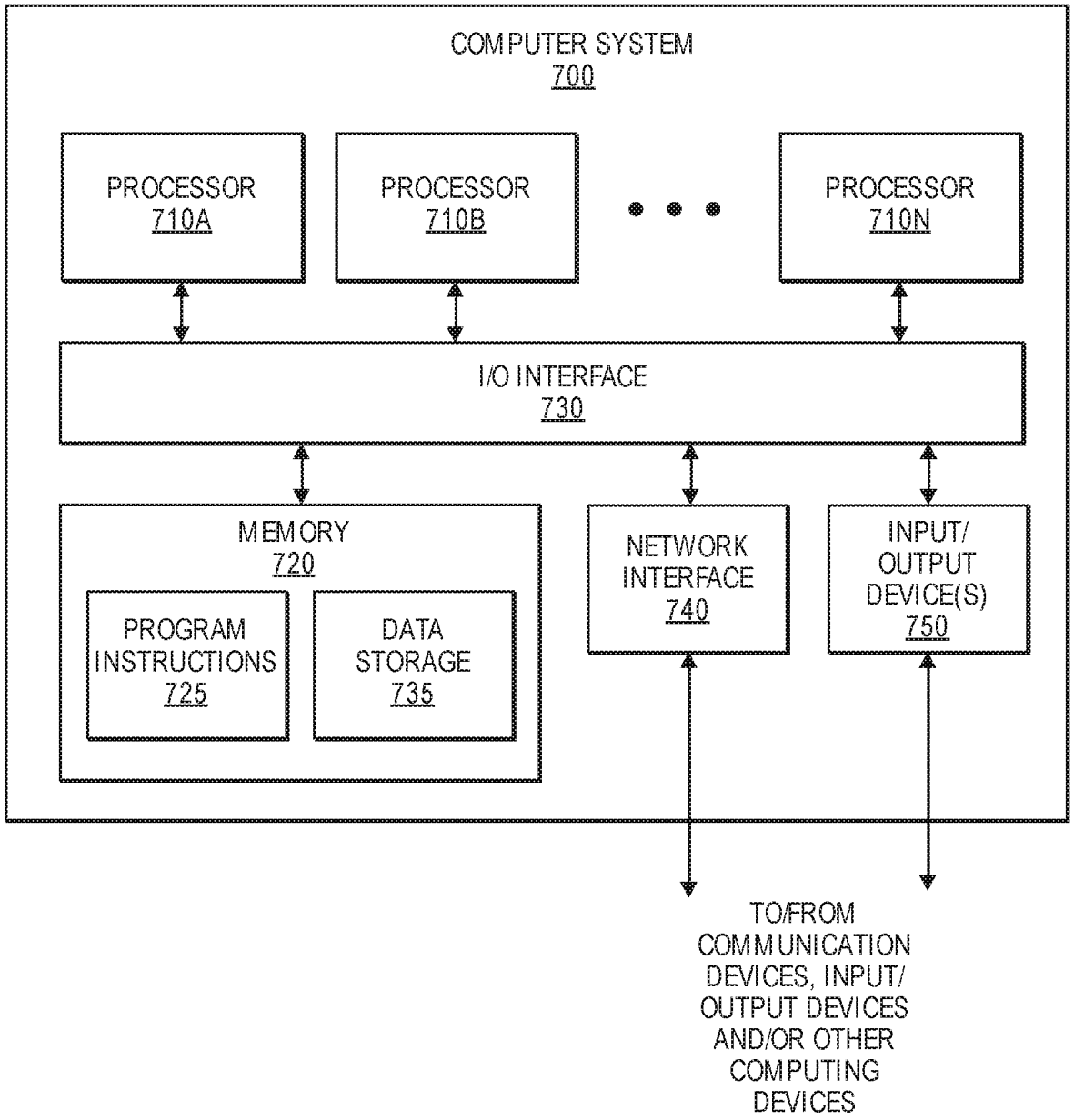
FIG. 7 is a block diagram illustrating an example computer system, according to an implementation.

As shown in FIG. 7, the memory 720 may include program instructions 725 which may be configured to implement one or more of the described implementations and/or provide data storage 735, which may comprise various tables, databases and/or other data structures accessible by the program instructions 725. In one implementation, the program instructions 725 may include various software modules configured to implement the various processes and systems discussed herein. The data storage 735 may include various data stores for maintaining one or more item lists, data representing physical characteristics of containers, items and/or other item parameter values, item package information, etc. The data storage 735 may also include one or more data stores for maintaining data representing delivery related feedback, such as customer ratings, customer preferences, experiences and the like.

Those skilled in the art will appreciate that the computing system 700 is merely illustrative and is not intended to limit the scope of implementations. In particular, the computing system and devices may include any combination of hardware or software that can perform the indicated functions, including computers, network devices, internet appliances, wireless phones, tablets, etc. The computing system 700 may also be connected to other devices that are not illustrated, or instead may operate as a stand-alone system. In addition, the functionality provided by the illustrated components may in some implementations be combined in fewer components or distributed in additional components. Similarly, in some implementations, the functionality of some of the illustrated components may not be provided and/or other additional functionality may be available.

Those skilled in the art will appreciate that, in some implementations, the functionality provided by the methods and systems discussed above may be provided in alternative ways, such as being split among more software modules or routines or consolidated into fewer modules or routines. Similarly, in some implementations, illustrated methods and systems may provide more or less functionality than is described, such as when other illustrated methods instead lack or include such functionality respectively, or when the amount of functionality that is provided is altered. In addition, while various operations may be illustrated as being performed in a particular manner (e.g., in serial or in parallel) and/or in a particular order, those skilled in the art will appreciate that, in other implementations, the operations may be performed in other orders and in other manners. The various methods, apparatus, and systems as illustrated in the figures and described herein represent example implementations. The methods and systems may be implemented in software, hardware, or a combination thereof in other implementations. Similarly, the order of any method may be changed and various elements may be added, reordered, combined, omitted, modified, etc., in other implementations.

From the foregoing, it will be appreciated that, although specific implementations have been described herein for purposes of illustration, various modifications may be made without deviating from the spirit and scope of the appended claims and the elements recited therein. In addition, while certain aspects are presented below in certain claim forms, the inventors contemplate the various aspects in any available claim form. For example, while only some aspects may currently be recited as being embodied in a computer-readable storage medium, other aspects may likewise be so embodied. Various modifications and changes may be made as would be obvious to a person skilled in the art having the benefit of this disclosure. It is intended to embrace all such modifications and changes and, accordingly, the above description is to be regarded in an illustrative rather than a restrictive sense.

What is claimed is:

1. A computing system, comprising:

one or more processors; and a memory coupled to the one or more processors and storing program instructions that when executed by the one or more processors cause the one or more processors to at least:

determine an insertion point into which an injector is to be inserted to penetrate a perimeter of a container and into an interior space of the container, wherein the container has been previously packed with an item, closed, and sealed;

send instructions that cause the injector to penetrate the container at the insertion point; and send instructions that cause a gas to be expelled through the injector after the injector has penetrated the container, wherein the gas causes a dunnage to be expelled from an interior of the injector to form a gas filled pouch within the interior space of the container so that the gas filled pouch fills at least a portion of the interior space of the container.

2. The computing system of claim 1, wherein the program instructions when executed by the one or more processors further cause the one or more processors to at least:

determine that a defined pressure has been achieved by the gas expelled into the dunnage; and send instructions that cause the gas filled pouch to be sealed and separated from the dunnage that has not been expelled from the injector.

3. The computing system of claim 1, wherein the program instructions when executed by the one or more processors further cause the one or more processors to at least:

determine that the gas filled pouch is to be sealed and separated;

send instructions that cause expulsion of the gas to terminate;

send instructions that cause an end of the gas filled pouch to be sealed and separated from the dunnage that has not been expelled from the injector;

determine that a second gas filled pouch is to be formed within the container; and send instructions that cause additional gas to be expelled through the injector after the gas filled pouch has been sealed and separated, such that the second gas filled pouch is formed within the interior space of the container so that the second gas filled pouch fills at least a second portion of the interior space of the container.

4. The computing system of claim 3, wherein the program instructions when executed by the one or more processors further cause the one or more processors to at least:

send instructions that cause an angle of the injector within the interior space of the container to be altered prior to the additional gas being expelled.

5. The computing system of claim 3, wherein the program instructions when executed by the one or more processors further cause the one or more processors to at least:

prior to sending the instructions that cause the additional gas to be expelled:

send instructions that cause the injector to be removed from the insertion point;

determine a second insertion point into which the injector is to be placed to penetrate the perimeter of the container and into the interior space of the container; and send instructions that cause the injector to penetrate the perimeter of the container at the second insertion point.

6. A computer-implemented method, comprising:

receiving a container that has already been packed with an item, closed, and sealed;

determining an insertion point into which an injector is to be inserted to penetrate a perimeter of the container;

causing the injector to penetrate the container at the insertion point; and causing a gas to be expelled through the injector after the injector has penetrated the container, wherein the gas causes a dunnage to be expelled from an interior of the injector to form a gas filled pouch within the container so that the gas filled pouch fills at least a portion of the container.

7. The computer-implemented method of claim 6, further comprising:

monitoring a speed rate at which the dunnage is expelled from the interior of the injector; and based at least in part on the monitoring, adjusting a friction roller of the injector to control a rate at which the dunnage is expelled from the interior of the injector.

8. The computer-implemented method of claim 6, further comprising:

inserting a negative vacuum nozzle into the container at a second insertion point; and extracting, with the negative vacuum nozzle, air from an interior of the container.

9. The computer-implemented method of claim 6, further comprising:

monitoring one or more of an amount of dunnage expelled, a pressure of the gas expelled, or a feed rate of the dunnage as it is expelled; and based at least in part on the monitoring, determining that the gas filled pouch is to be sealed.

10. The computer-implemented method of claim 6, further comprising:

terminating the expulsion of the gas;

causing an end of the gas filled pouch to be sealed from the dunnage that has not been expelled from the injector;

determining that a second gas filled pouch is to be formed within the container; and causing additional gas to be expelled through the injector after the gas filled pouch has been sealed, such that the second gas filled pouch is formed within the container so that the second gas filled pouch fills at least a second portion of the container.

11. The computer-implemented method of claim 10, further comprising:

causing an angle of the injector to be altered prior to the additional gas being expelled.

12. The computer-implemented method of claim 6, wherein determining the insertion point is based at least in part on one or more of a known size of the container, a known shape of the container, a known size of the item, a known shape of the item, or a location of a void within the container.

13. The computer-implemented method of claim 6, wherein determining the insertion point is based at least in part on an image processing of an image obtained during a packing of the item into the container to determine a void in the container.

14. The computer-implemented method of claim 6, further comprising:

determining at least one of a dunnage volume of the dunnage to be injected into the container, a gas volume of the gas to be expelled into the container, or a gas pressure to be achieved through the expulsion of the gas.

15. The computer-implemented method of claim 14, wherein the dunnage volume, the gas volume, or the gas pressure are determined based at least in part on one or more of a dimension of the container, a type of the container, a dimension of the item, a type of the item, a transportation information for the container, a customer preference, or an image analysis of one or more images of an interior of the container after the item was placed into the container.

16. A computing system, comprising:

one or more processors; and a memory coupled to the one or more processors and storing program instructions that when executed by the one or more processors cause the one or more processors to at least:

send instructions that cause an injector to penetrate a container at an insertion point;

send instructions that cause a gas to be expelled through the injector after the injector has penetrated the container, wherein the gas causes a dunnage to be expelled from an interior of the injector to form a gas filled pouch within the container so that the gas filled pouch fills at least a portion of the container;

determine that the gas filled pouch is to be sealed; and cause the gas filled pouch to be sealed.

17. The computing system of claim 16, wherein the program instructions when executed by the one or more processors further cause the one or more processors to at least:

monitor a pressure of the expelled gas to determine when the gas filled pouch has expanded and is pressing against at least one of an interior surface of the container or an item within the container, as indicated by the pressure; and wherein the determination that the gas filled pouch is to be sealed is based at least in part on the monitoring.

18. The computing system of claim 16, wherein the program instructions when executed by the one or more processors further cause the one or more processors to at least:

determine an angle at which the injector is to be inserted into the container.

19. The computing system of claim 16, wherein the program instructions when executed by the one or more processors further cause the one or more processors to at least:

determine that a second gas filled pouch is to be formed within the container; and send instructions that cause additional gas to be expelled through the injector after the gas filled pouch has been sealed, such that the second gas filled pouch is formed within the container so that the second gas filled pouch fills at least a second portion of the container.

20. The computing system of claim 16, wherein the program instructions when executed by the one or more processors further cause the one or more processors to at least:

determine a type of dunnage to be used, wherein the dunnage is at least one of a polyethylene, a low-density polyethylene, a linear low-density polyethylene, a bioplastic, or a degradable polyethylene film.

* * * * *